US008379045B2

(12) United States Patent
Hsieh et al.

(10) Patent No.: US 8,379,045 B2
(45) Date of Patent: Feb. 19, 2013

(54) IMAGE PROCESSING CIRCUIT AND METHOD THEREOF

(75) Inventors: Pe-Lin Hsieh, Taipei County (TW); Hsiang-Tan Lin, Keelung (TW); Yu-Ju Lee, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 978 days.

(21) Appl. No.: 12/275,230

(22) Filed: Nov. 21, 2008

(65) Prior Publication Data

US 2009/0256853 A1 Oct. 15, 2009

(30) Foreign Application Priority Data

Apr. 9, 2008 (TW) ..... 97112825 A

(51) Int. Cl.
*G09G 5/02* (2006.01)

(52) U.S. Cl. ..... 345/590

(58) Field of Classification Search ..... 345/590
See application file for complete search history.

(56) References Cited

U.S. PATENT DOCUMENTS

| | | | | |
|---|---|---|---|---|
| 5,299,291 | A | 3/1994 | Ruetz | |
| 5,510,910 | A | 4/1996 | Bockman et al. | |
| 5,943,143 | A | 8/1999 | Kawai et al. | |
| 2004/0136563 | A1 * | 7/2004 | Sarraf et al. | 382/100 |
| 2005/0062756 | A1 * | 3/2005 | Dyke et al. | 345/604 |
| 2005/0147294 | A1 | 7/2005 | Pettitt et al. | |

* cited by examiner

*Primary Examiner* — Aaron M Richer
(74) *Attorney, Agent, or Firm* — Jianq Chyun IP Office

(57) ABSTRACT

An image processing circuit including an input unit and a first multiplier is provided. The input unit is used for receiving an image data, and obtaining a plurality of color signal values for forming the image data. The first multiplier is used for multiplying the color signals by a transfer matrix to obtain a plurality of transfer color signal values, so as to form a display image.

13 Claims, 5 Drawing Sheets

IMAGE PROCESSING CIRCUIT AND METHOD THEREOF

CROSS-REFERENCE TO RELATED APPLICATION

This application claims the priority benefit of Taiwan application serial no. 97112825, filed on Apr. 9, 2008. The entirety of the above-mentioned patent application is hereby incorporated by reference herein and made a part of specification.

BACKGROUND OF THE INVENTION

1. Field of the Invention

The present invention relates to an image processing technique. More particularly, the present invention relates to an image processing technique for transferring an image from a wide gamut to a preset gamut.

2. Description of Related Art

In recent years, liquid crystal displays (LCDs) have been widely used and gradually replaced the cathode ray tube (CRT) displays to become one of the main streams for the next generation of displays. As the semiconductor technique has been gradually improved, the LCDs are made to have advantages of low power consumption, thin thickness, light weight, high resolution, high color saturation, and long lifetime etc. Therefore, they have been widely applied on the screens of computers, TV sets, and other electronic products closely relevant to personal life.

Currently, those LCDs with wide gamut display colors with high saturation. Therefore, such LCDs have become the main stream products for the LCD devices. The main reason lies in that, three primary color values for the LCD with the wide gamut, i.e. red value (R), green value (G), and blue value (B), are all located on relatively peripheral positions of the gamut diagram.

The so-called gamut refers to a color image device displays a range of the color types actuality. Generally, the color-mixing principle is to add the white color to three primary colors to obtain all the colors in the gamut. However, the three primary color values of the LCD with the wide gamut are distributed on relatively peripheral positions of the gamut diagram if such saturated colors are used to be mixed into the middle colors in the gamut. As a result, the image frame is made to be unnatural.

SUMMARY OF THE INVENTION

Accordingly, the present invention is directed to an image processing circuit and a method thereof, which are capable of transferring an image from a wide gamut to a preset gamut that satisfies the international color specification, so as to make the image display naturally, without sacrificing the saturation of the image.

In addition, the image processing circuit and the method thereof provided by the present invention are capable of transferring the gamut of the image without requiring complex algorithms for operation.

The present invention provides an image processing circuit including an input unit and a first multiplier. The input unit is used to receive an image data and to obtain a plurality of color signal values for forming the image data. The first multiplier is used to multiply the color signals by a transfer matrix to obtain a plurality of transfer color signal values, so as to form a display image.

In an embodiment of the present invention, the form of the transfer matrix may be independently designed by a user.

In addition, the transfer matrix may also be generated by a matrix generating unit. In the embodiment of the present invention, the matrix generating unit includes a comparator, an adder, a divider, an operational unit, and a second multiplier. The comparator is used to compare and then output a maximum value of the color signal values, and the adder is used to calculate a sum of the color signal values. In addition, the divider is coupled to the comparator and the adder, and is used to divide the maximum value of the color signal values by the sum of the color signal values, so as to obtain a condition value and then output the condition value to the operational unit. In this manner, the operational unit may calculate a weighted value according to a numerical interval where the condition value falls in. In addition, the second multiplier may receive an operation matrix, and multiply at least a part of the element values in the operation matrix by the weighted value to obtain the transfer matrix.

From another aspect, the present invention also provides an image processing method, which includes obtaining a plurality of color signal values for forming an image, and multiplying the color signal values by a transfer matrix to obtain a plurality of transfer color signal values, so as to form a display image.

In the embodiment of the present invention, element values of the transfer matrix on a principal diagonal from top left to bottom right are all 1.

In the present invention, the color signals are multiplied by the transfer matrix to obtain a plurality of transfer color signals to form the display image, so the present invention is capable of transferring the image from the wide gamut to the preset gamut without requiring the complex mathematical operations.

In addition, in the present invention, the weighted value may be calculated according to the numerical interval where the condition value falls in, so as to further obtain the transfer matrix, and thus, the present invention is capable of transferring the image to the preset gamut without sacrificing the image saturation.

In order to make the aforementioned and other objects, features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
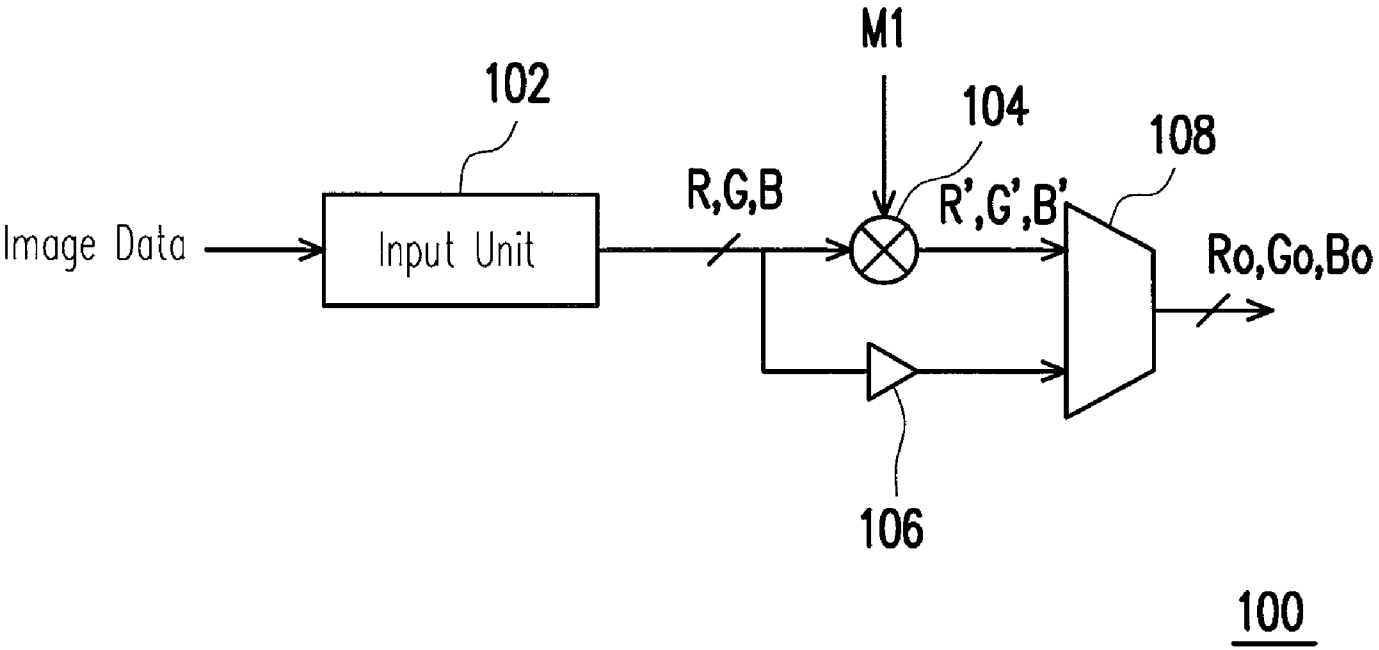
FIG. 1 is a block diagram of an image processing circuit according to a preferred embodiment of the present invention.

FIG. 1 is a block diagram of an image processing circuit according to a preferred embodiment of the present invention. Referring to FIG. 1, an image processing circuit 100 provided by the present invention at least includes an input unit 102 and a first multiplier 104. In an alternative embodiment, the image processing circuit 100 may also include a delay unit 106 and a selector 108. In this embodiment, for example, an output of the input unit 102 is coupled to the first multiplier 104 and the delay unit 106, and outputs of the first multiplier 104 and the delay unit 106 are respectively coupled to different input ends of the selector 108.

Figure 2:
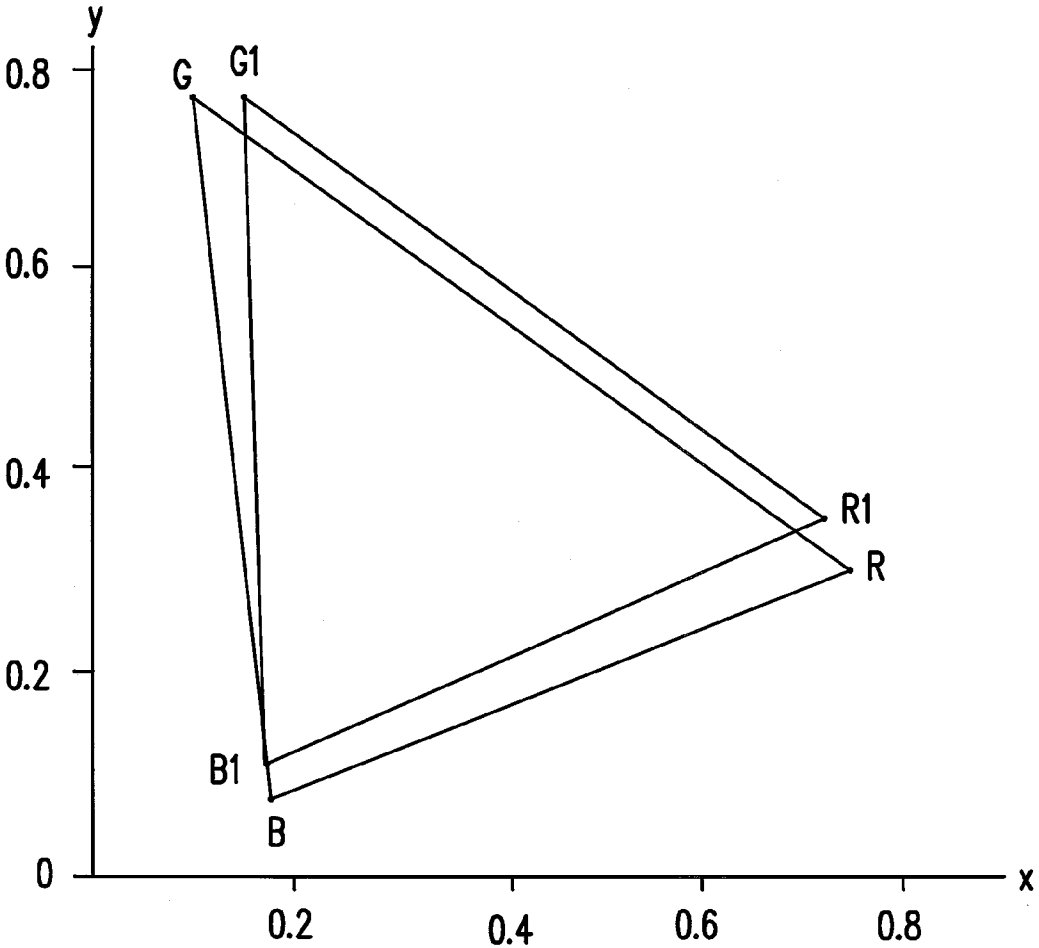
FIG. 2 is a gamut diagram of the distribution for color signal values of the image data in FIG. 1.

The input unit 102 is used to receive an image data and to output a plurality of color signal values for forming the image data, for example, a red color signal value R, a green color signal value G, and a blue color signal value B. In this embodiment, the image data received by the input unit 102 may be an image data of a wide gamut. Therefore, the color signal values R, G, and B for forming the image data are distributed at relatively peripheral parts of the gamut diagram as shown in FIG. 2. However, in order to make the image data satisfy the international specification (for example, NTSC, EBU, and SRGB etc.), the image data is required to be transferred from the original gamut into a certain set object gamut scope, such as the scope surrounded by R1, G1, and B1, shown in FIG. 2.

In order to transfer the image data of the wide gamut received by the input unit 102 into the preset ideal gamut, the first multiplier 104 respectively multiplies the color signal values R, G, B of the image data by a transfer matrix M1, so as to generate a plurality of transfer image signals R', G', and B', so as to form a display image in the preset gamut scope. In this embodiment, the transfer matrix M1 may be a multi-dimensional matrix, for example, the matrix shown below:

$$\begin{bmatrix} 1 & 0.0694 & -0.0103 \\ 0.067 & 1 & -0.027 \\ -0.018 & 0.0854 & 1 \end{bmatrix}. \quad (1)$$

In the matrix of Equation (1), element values on a principal diagonal from top left to bottom right are all 1. Although in this embodiment, the matrix of the equation (1) is taken as the transfer matrix, it is only used for reference. Those of ordinary skill in the art must know that, the form of the transfer matrix may be independently designed by the user depending upon actual situation, which is not limited in the present invention.

In order to enable the user to make a more flexible selection, in the image processing circuit 100, the delay unit 106 and the selector 108 are further disposed. The delay unit 106 is used to receive and then send the original color signal values R, G, and B to the selector 108. According to the user's selection, the selector 108 determines to select the transfer color signal values R', G', B' or the original color signal values R, G, B as the output Ro, Go, Bo to generate the display image. In this manner, the user may select to use and to view the display image of the wide gamut or the display image satisfying the preset gamut.

Although in the above embodiment, the image data can be easily transferred from the wide gamut to the present gamut through simple matrix operations, gradient effect on the display image in the above embodiment may be sacrificed, or the saturation of the display image may be reduced. Therefore, the situation that the saturation is reduced when the image data is transferred from the wide gamut to the preset gamut A matrix generating unit is further provided below, which is capable of dynamically generating different transfer matrixes M1 according to the color distribution of each image data.

Figure 3:
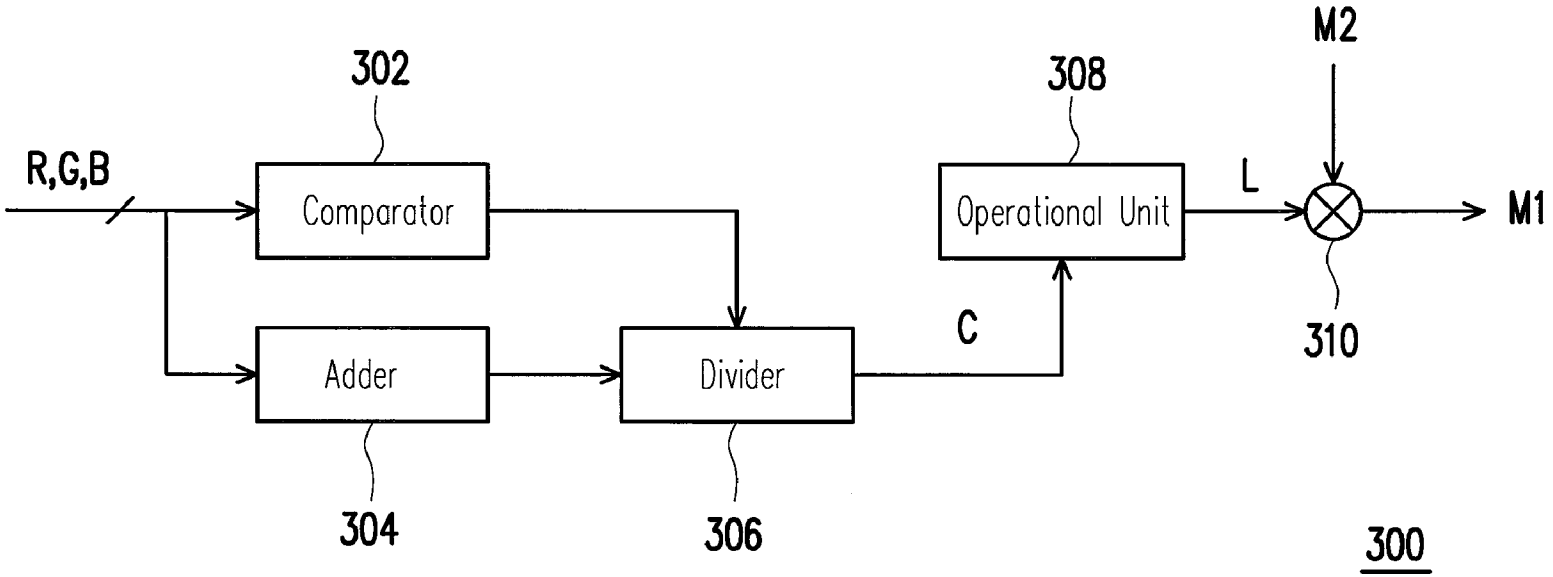
FIG. 3 is a circuit block diagram of a matrix generating unit according to a preferred embodiment of the present invention.

FIG. 3 is a circuit block diagram of a matrix generating unit according to a preferred embodiment of the present invention. Referring to FIG. 3, a matrix generating unit 300 includes a comparator 302, an adder 304, a divider 306, an operational unit 308, and a second multiplier 310. The comparator 302 and the adder 304 are both used to receive the color signal values R, G, B, and their outputs are both coupled to the divider 306. In addition, the output of the divider 306 is coupled to the operational unit 308, and the output of the operational unit 308 is coupled to the second multiplier 310.

Figure 4:
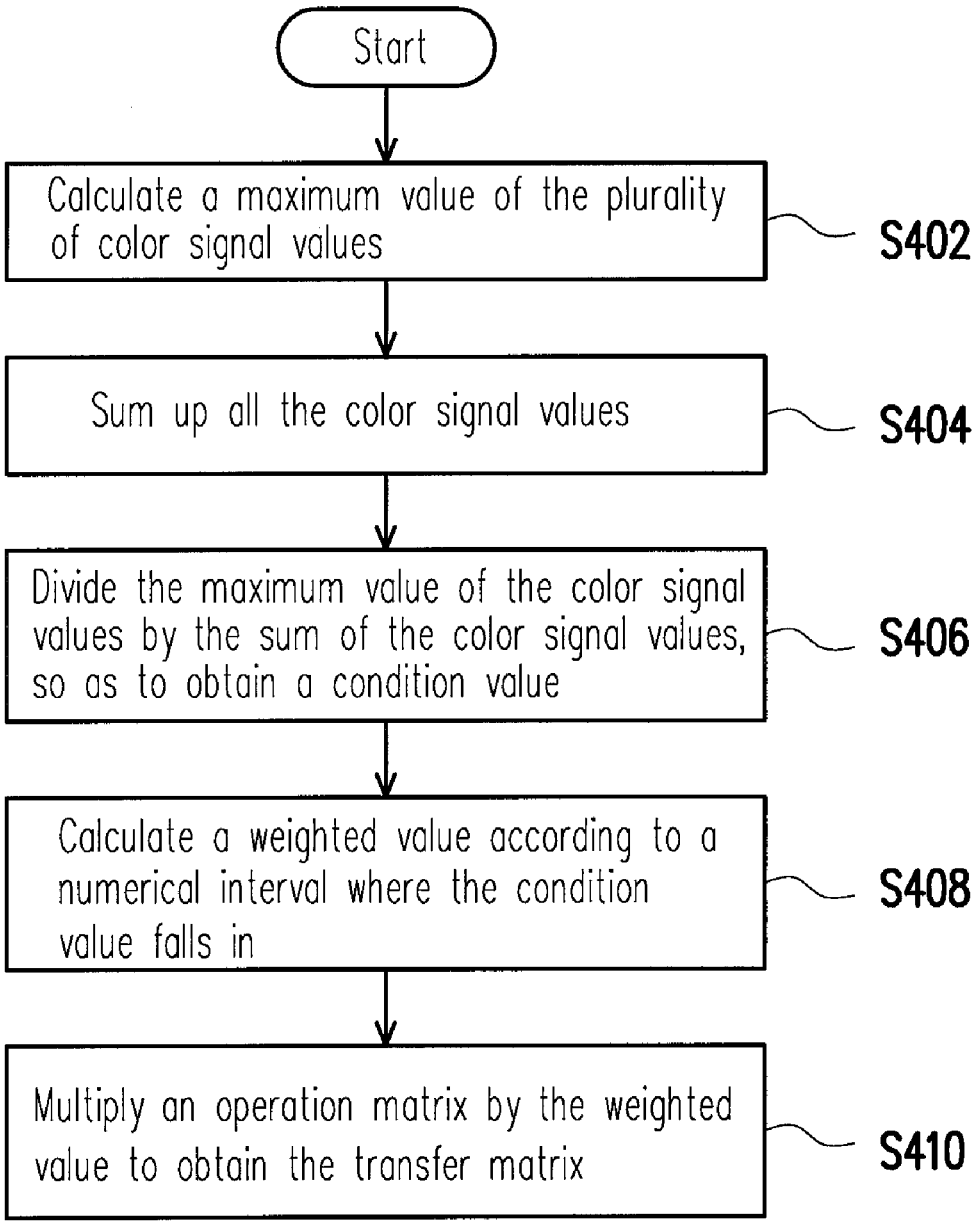
FIG. 4 is a flow chart of steps for generating a transfer matrix according to a preferred embodiment of the present invention.

FIG. 4 is a flow chart of steps for generating the transfer matrix according to a preferred embodiment of the present invention. Referring to FIGS. 3 and 4, after the comparator 302 receives the color signal values R, G, B, as in Step S402, the maximum value of the three values is calculated and then output to the divider 306. In addition, the adder 304 sums up the color signal values R, G, B, so as to obtain a sum of the three (Step S404). Once the divider 306 receives the output of the comparator 302 and the adder 304, as in Step S406, the maximum value of the color signal values R, G, B is divided by the sum of the three values, so as to obtain a condition value C.

The operational unit 308 receives the output from the divider 306, and then, the operational unit 308 calculates a weighted value L according to the numerical interval where the condition value C falls in, as in Step S408. Here, the boundary values of the gamut are used to analyze data of the condition value C and, please refer to the table below.

TABLE 1

| | | RGB Signal Value | Condition Value C |
|---|---|---|---|
| Primary Color | R | (255,0,0) | 1 |
| | G | (0,255,0) | 1 |
| | B | (0,0,255) | 1 |
| Secondary Color | Y | (255,255,0) | ½ |
| | M | (255,0,255) | ½ |
| | C | (0,255,255) | ½ |
| Tertiary Color | W | (255,255,255) | ⅓ |
| | K | (0,0,0) | 0 |

It can be clearly seen from the analysis of Table 1 that, the condition value C falls between 1 and 0. If the black part is not considered, the condition value falls between 1 and ⅓. When the condition value C is equal to ⅓, it represents that the color shown by the display frame is white. When the condition value C falls between 1 and ½, it represents that the colors displayed by the display frame are those colors with higher saturation.

In order to maintain the color temperature of the white color and the gray balance in color, it does not intend to change the white color and grayscale axis part in the frame. Therefore, in this embodiment, the following mathematical equation is designed to enable the operational unit 308 to generate a preferred weighted value L:

$$L = \begin{cases} 12C - 4, & \text{if } \frac{1}{3} \le C < \frac{5}{12} \\ -12C + 6, & \text{if } \frac{5}{12} \le C < \frac{1}{2} \\ 0, & \text{if } C \ge \frac{1}{2}. \end{cases} \quad (2)$$

Figure 5:
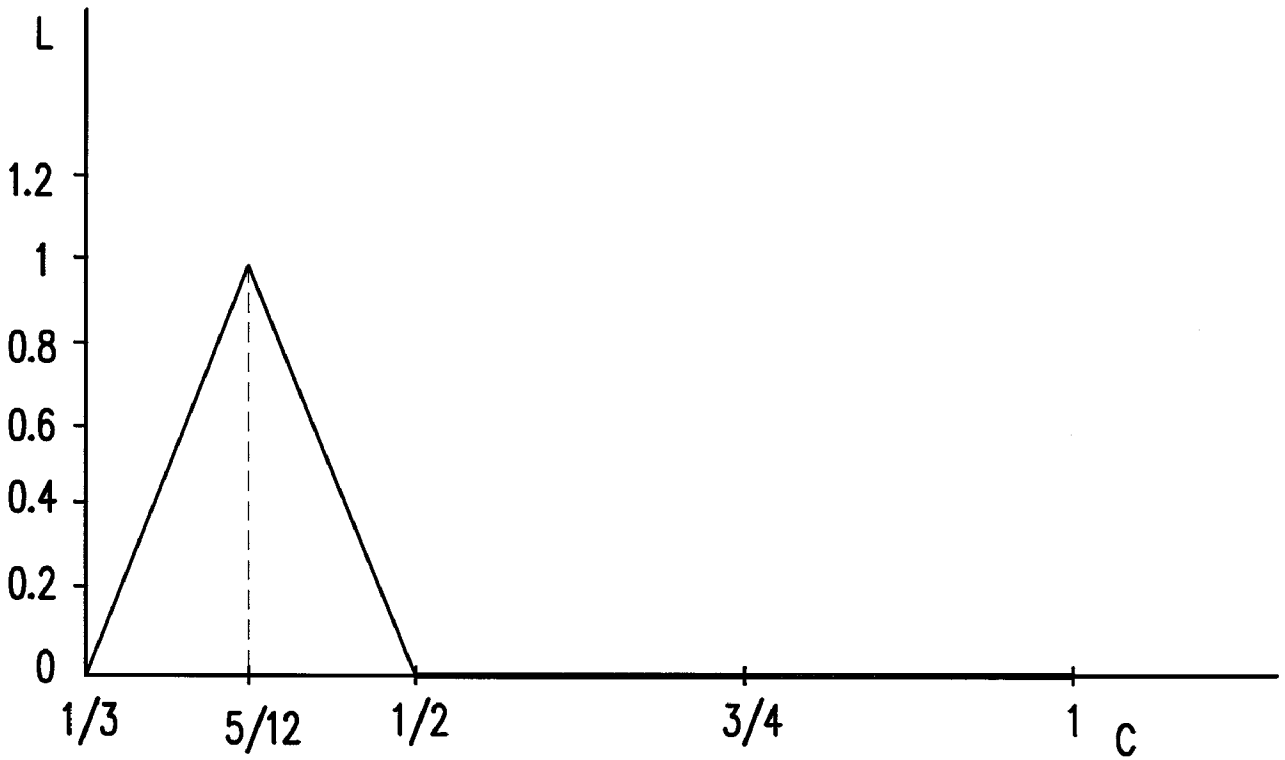
FIG. 5 is a relationship diagram between a condition value and a weighted value.

FIG. 5 is a relationship diagram between the condition value C and the weighted value L calculated through Equation (2). Referring to FIG. 5, when the condition value C is in a first interval, that is, between ⅓ and 5/12, it represents that the display frame is transferred from white color to middle colors, and the transfer extent thereof is to increasingly change from the no transfer extent for the original white color to a relatively large transfer extent for the middle colors. Therefore, the weighted value L is an increasing linear function from 0 to 1. When the condition value C is in a second interval, that is, between 5/12 and ½, it represents that the display frame is transferred from the middle colors to those colors with high saturation, in order to avoid sacrificing the colors with high saturation, the weighted value L shows a reducing linear function from 1 to 0 corresponding to such changing process. When the condition value is in a third interval, that is, between ½ and 1, it represents that the colors of the display frame are totally colors of high saturation. It is not desired that color purity is lost because of the transferring process, so the weighted value L is set as 0 in the third interval.

Referring to FIGS. 3 and 4, after the operational unit 308 calculates the weighted value L as described above, the operational unit 308 sends the weighted value L to the second multiplier 310. Then, the second multiplier 310 further receives an operation matrix M2. In this manner, as described in Step S410, the second multiplier 310 multiplies the operation matrix M2 by the output weighted value L output from the operational unit 308, so as to obtain the transfer matrix M1.

The operation matrix may be independently set by the user, and in this embodiment, the matrix provided by Equation (1) is taken as the operation matrix. Therefore, in this embodiment, the transfer matrix output by the second multiplier 310 is for example shown as follows:

$$\begin{bmatrix} 1 & 0.0694 \times L & -0.0103 \times L \\ 0.067 \times L & 1 & -0.027 \times L \\ -0.018 \times L & 0.0854 \times L & 1 \end{bmatrix}. \quad (3)$$

In Equation (3), the weighted value is changed with the saturation status of the display frame. Therefore, the transfer matrix M1 is not fixed, but can be adjusted according to the situation of the display frame.

Although the Equations (2) and (3) are provided for demonstrating the calculating manner of the weighted value and the transfer matrix, they are not intended to limit the present invention. Those of ordinary skill in the art can modify Equations (2) and (3) according to the practical status, and it does not influence the spirit of the present invention.

To sum up, the present invention at least has the following advantages.

1. The present invention is capable of transferring the image from the wide gamut to any gamut according to the practical demands, so as to satisfy different international color specifications. Therefore, the present invention is suitable for any display.

2. The present invention is capable of transferring the image from the wide gamut to the preset gamut merely through the multi-dimensional matrix operations, for example, three-dimensional matrix operation without requiring too complex calculation.

3. The transfer matrix generated by the present invention can be independently adjusted according to the demands for the image saturation at different times. Therefore, the present invention can transfer the image from the wide gamut to the preset gamut without sacrificing the color saturation.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image processing circuit, suitable for transferring an image data from a wide gamut to a preset gamut, comprising:

an input unit, receiving the image data, and obtaining a plurality of color signal values for forming the image data;

a first multiplier, multiplying the color signals by a transfer matrix, and obtaining a plurality of transfer color signal values, so as to form a display image; and a matrix generating unit generating the transfer matrix, wherein the matrix generating unit comprises:

a comparator, receiving the color signal values, and outputting a maximum value of the color signal values;

an adder, calculating a sum of the color signal values;

a divider, coupled to the comparator and the adder, for dividing the maximum value of the color signal values by the sum of the color signal values, and obtaining a condition value;

an operational unit, calculating a weighted value according to a numerical interval where the condition value falls in; and a second multiplier, receiving an operation matrix for multiplying at least a part of element values in the operation matrix by the weighted value to obtain the transfer matrix.

2. The image processing circuit as claimed in claim 1, wherein the first transfer matrix is a multi-dimensional matrix.

3. The image processing circuit as claimed in claim 1, wherein a plurality of element values of the transfer matrix on a principal diagonal from top left to bottom right are all 1.

4. The image processing circuit as claimed in claim 1, wherein the operation matrix is a multi-dimensional matrix.

5. The image processing circuit as claimed in claim 1, wherein a plurality of element values of the operation matrix on a principal diagonal from top left to bottom right are all 1.

6. The image processing circuit as claimed in claim 1, wherein the second multiplier multiplies the element values in the operation matrix except the element values on the principal diagonal from top left to bottom right by the weighted value, and obtains the transfer matrix.

7. The image processing circuit as claimed in claim 1, further comprising:

a delay unit, for receiving the color signals; and a selector, coupled to outputs of the first multiplier and the delay unit, for selecting one from the color signals and the transfer color signals for being output, so as to obtain the display image.

8. An image processing method, suitable for an image processing circuit transferring an image data from a wide gamut to a preset gamut, comprising:

obtaining a plurality of color signal values used for forming an image data by an input unit; and multiplying the color signal values by a transfer matrix to obtain a plurality of transfer color signal values by a first multiplier, so as to form a display image, wherein the process for obtaining the transfer matrix comprises:

finding out a maximum value of the color signal values by a comparator;

summing up the color signal values by an adder;

dividing the maximum value of the color signals by the sum of the color signals, so as to obtain a condition value by a divider; and calculating a weighted value according to a numerical interval where the condition value falls in by an operational unit, so as to obtain the transfer matrix.

9. The image processing method as claimed in claim 8, wherein the transfer matrix is a multi-dimensional matrix.

10. The image processing method as claimed in claim 8, wherein a plurality of element values of the transfer matrix on a principal diagonal from top left to bottom right are all 1.

11. The image processing method as claimed in claim 8, wherein the form of the transfer matrix is independently designed by a user.

12. The image processing method as claimed in claim 8, wherein the process for obtaining the transfer matrix further comprises:

providing a multi-dimensional operation matrix, wherein a plurality of element values of the multi-dimensional operation matrix on a principal diagonal from top left corner to bottom right corner are all 1; and multiplying the element values in the multi-dimensional operation matrix except those on the principal diagonal by the weighted value by a second multiplier, so as to obtain the transfer matrix.

13. The image processing method as claimed in claim 8, wherein the process for obtaining the weighted value comprises:

defining the weighted value as an increasing linear function between 0 and 1 with a variable as the condition value, when the condition value is larger than 0 and smaller than a first preset value;

defining the weighted value as a reducing linear function between 0 and 1 with a variable as the condition value, when the condition value is larger than the first preset value and smaller than a second preset value; and making the weight value as 0, when the condition value is larger than the second preset value and smaller than 1.

* * * * *